US007695794B2

(12) United States Patent
Oosterbroek et al.

(10) Patent No.: US 7,695,794 B2
(45) Date of Patent: Apr. 13, 2010

(54) TUFTED NONWOVEN, BONDED NONWOVEN, METHODS FOR THEIR MANUFACTURE AND USES

(75) Inventors: Maarten Oosterbroek, Westervoort (NL); Jan Dijkema, Zutphen (NL); Edze Jan Visscher, Utrecht (NL)

(73) Assignee: Colbond B.V., Arnhem (NL)

( * ) Notice: Subject to any disclaimer, the term of this patent is extended or adjusted under 35 U.S.C. 154(b) by 415 days.

(21) Appl. No.: 11/794,128

(22) PCT Filed: Jan. 25, 2006

(86) PCT No.: PCT/EP2006/000629

§ 371 (c)(1),
(2), (4) Date: Jun. 26, 2007

(87) PCT Pub. No.: WO2006/079511

PCT Pub. Date: Aug. 3, 2006

(65) Prior Publication Data

US 2008/0116129 A1 May 22, 2008

(30) Foreign Application Priority Data

Jan. 27, 2005 (EP) ..... 05001619

(51) Int. Cl.

| | |
|---|---|
| ***D05C 15/00*** | (2006.01) |
| ***D05C 15/04*** | (2006.01) |
| ***D05C 17/02*** | (2006.01) |
| ***D04H 3/08*** | (2006.01) |
| ***D04H 3/14*** | (2006.01) |

(52) U.S. Cl. ..... 428/95; 156/72; 156/180; 156/181; 264/171.1; 264/172.15; 428/96; 442/361; 442/364; 210/505

(58) Field of Classification Search ..... 428/95, 428/96; 442/361, 362, 363, 364; 156/72, 156/166, 180, 181; 264/103, 171.1, 172.13, 264/172.14, 172.15; 210/500.1, 503, 505
See application file for complete search history.

(56) References Cited

U.S. PATENT DOCUMENTS

| | | | | |
|---|---|---|---|---|
| 6,103,181 | A * | 8/2000 | Berger | 264/555 |
| 6,330,883 | B1 * | 12/2001 | Berger | 128/201.13 |
| 6,576,034 | B2 * | 6/2003 | Berger | 55/527 |
| 6,596,049 | B1 * | 7/2003 | Berger | 55/528 |
| 6,602,311 | B2 * | 8/2003 | Berger | 55/528 |
| 6,616,723 | B2 * | 9/2003 | Berger | 55/527 |
| 6,833,104 | B2 * | 12/2004 | Berger | 264/555 |
| 7,179,412 | B1 * | 2/2007 | Wilkie et al. | 264/172.11 |
| 7,192,550 | B2 * | 3/2007 | Berger et al. | 264/555 |
| 2002/0116910 | A1 * | 8/2002 | Berger | 55/528 |
| 2002/0134063 | A1 * | 9/2002 | Berger | 55/528 |
| 2002/0139099 | A1 * | 10/2002 | Berger | 55/528 |
| 2002/0144490 | A1 | 10/2002 | Berger | |
| 2003/0196421 | A1 * | 10/2003 | Berger | 55/527 |
| 2005/0142325 | A1 * | 6/2005 | Veurink et al. | 428/95 |
| 2005/0186290 | A1 * | 8/2005 | Cals-Grierson | 424/725 |
| 2008/0116129 | A1 * | 5/2008 | Oosterbroek et al. | 210/500.1 |
| 2009/0152191 | A1 * | 6/2009 | Dijkema et al. | 210/505 |
| 2009/0304953 | A1 | 12/2009 | Dijkema et al. | |

FOREIGN PATENT DOCUMENTS

| | | |
|---|---|---|
| JP | A-11-309063 | 11/1999 |
| WO | WO 00/12800 A2 | 3/2000 |
| WO | WO 03/069039 A1 | 8/2003 |

OTHER PUBLICATIONS

Dr. R. Krčma, Chapter 10.1 of the "Manual of Nonwovens" (1971), Textile Trade Press, Manchester, England pp. 202-231.

* cited by examiner

*Primary Examiner*—Cheryl Juska
(74) *Attorney, Agent, or Firm*—Oliff & Berridge, PLC

(57) ABSTRACT

A tufted nonwoven includes a face material which tufts a bonded nonwoven having a mixture of a plurality of bicomponent filaments 1 with a plurality of bicomponent filaments 2. At least bicomponent filaments 1 have component 11 and component 12. Component 11 exhibits a melting temperature $T_m(11)$, and component 22 of the bicomponent filaments 2 exhibits a melting temperature $T_m(22)$. Component 12 exhibits a melting temperature $T_m(12)$, and component 21 of the second bicomponent filaments exhibits a melting temperature $T_m(21)$, and $T_m(12)$ is higher than $T_m(21)$. The melting temperatures of components 11 and 22 and the melting temperatures of components 12 and 21 obey a relationship in which $T_m(11)$ and $T_m(22)>T_m(12)>$first $T_m(21)$ and optionally wherein the face material is bonded to bicomponent filaments 2 by a solidified melt of component 21. Also described are a bonded nonwoven and methods for their manufacture.

25 Claims, No Drawings

TUFTED NONWOVEN, BONDED NONWOVEN, METHODS FOR THEIR MANUFACTURE AND USES

BACKGROUND OF THE INVENTION

1. Field of Invention

The present disclosure relates to a tufted nonwoven, a bonded nonwoven, methods for their manufacture and uses thereof.

2. Description of Related Art

WO 00/12800 discloses a nonwoven primary carpet backing comprising thermoplastic polymer filaments or fibers bonded by means of a binder polymer, wherein the backing comprises at least a distinguishable thermoplastic woven layer, a distinguishable thermoplastic continuous layer, or a distinguishable nonwoven layer also comprising filaments or fibers bonded by means of a binder polymer. If the primary carpet backing is tufted, an increased stitch lock (stitch holding) is observed however in combination with a reduced delamination strength of the backing.

US 2002/0144490 discloses a fiber spinning process for manufacturing a web of fibers comprising a homogeneous mixture of fibers of different characteristics. Bicomponent fibers having a common core polymer and different sheath polymers can be extruded from alternate spinneret orifices in the same die plate. Products formed from the improved mixed fiber technology are useful as high efficiency filters in various environments, coalescent filters, reservoirs for marking and writing instruments, wicks and other elements designed to hold and transfer liquids for medical and other applications, heat and moisture exchangers and other diverse fibrous matrices.

SUMMARY

Therefore, one object disclosed herein is to provide a method to manufacture a nonwoven which after tufting yields a tufted nonwoven exhibiting an increased stitch holding without reduced delamination strength.

EMBODIMENTS

A method to manufacture a tufted nonwoven with improved stitch holding is provided.

The features of the tufted nonwoven disclosed herein and as described below are identified by numerals for convenience and clarity. The numerals for the features do not correspond to a drawing or figure. The features include first bicomponent filaments (hereinafter "bicomponent filaments 1"), second bicomponent filaments (hereinafter "bicomponent filaments 2"), a first component of the first bicomponent filaments (hereinafter "component 11"), a melting temperature of the first component of the first bicomponent filaments (hereinafter "$T_m(11)$"), a second component of the first bicomponent filaments (hereinafter "component 12") a melting temperature of the second component of the first bicomponent filaments (hereinafter "$T_m(12)$"), a first component of the second bicomponent filaments (hereinafter "component 21"), a melting temperature of the first component of the second bicomponent filaments (hereinafter "$T_m(21)$"), a second component of the second bicomponent filaments (hereinafter "component 22"), and a melting temperature of the second component of the second bicomponent filaments (hereinafter "$T_m(22)$").

The method includes the following:

a) mixing a plurality of bicomponent filaments 1 which comprise a component 11 and a component 12 with a plurality of bicomponent filaments 2 which comprise a component 21 and a component 22 wherein
   - iα) at least bicomponent filaments 1 exhibit a core/sheath geometry wherein component 11 represents the core and component 12 represents the sheath, or
   - iβ) at least bicomponent filaments 1 exhibit a side by side geometry wherein component 11 represents side 1 and component 12 represents side 2, or
   - iγ) at least bicomponent filaments 1 exhibit islands in the sea geometry wherein component 11 represents the islands and component 12 represents the sea,
   - ii) the component 11 exhibits a melting temperature, $T_m(11)$, the component 22 exhibits a melting temperature, $T_m(22)$, and $T_m(11)$ is equal to $T_m(22)$ or $T_m(11)$ is not equal to $T_m(22)$,
   - iii) the component 12 exhibits a melting temperature, $T_m(12)$, the component 21 exhibits a melting temperature, $T_m(21)$, and $T_m(12)$ is higher than $T_m(21)$, and
   - iv) the melting temperatures of both component 11 and component 22 and the melting temperatures of components 12 and component 21 obey a relationship in which both $T_m(11)$ and $T_m(22)>T_m(12)>T_m(21)$, and producing a basic fibrous layer in a method known per se in which bicomponent filaments 1 contact bicomponent filaments 2 at zones of overlap,
b) heating the basic fibrous layer at a temperature for nonwoven production $T_{np}$ which obeys to the relation $T_m(12)<T_{np}<$both $T_m(11)$ and $T_m(22)$ till component 12 and component 21 melt at the zones of overlap and then cooling below $T_m(21)$ resulting in a bonded nonwoven,
c) tufting the bonded nonwoven with a face material resulting in a tufted nonwoven, exhibiting contacts between the face material and bicomponent filaments 1 and 2, and optionally
d) heating the tufted nonwoven at a temperature $T_m$ which obeys to the relation $T_m(12)>T_m>T_m(21)$ till component 21 melts resulting in a tufted nonwoven in which molten component 21 contacts the face material and then cooling the nonwoven below $T_m(21)$ to obtain the tufted nonwoven with improved stitch holding.

According to step a)iα), at least the bicomponent filaments 1 exhibit a core/sheath geometry wherein component 11 represents the core and component 12 represents the sheath. Within the scope of the present disclosure, this means that either bicomponent filaments 1 and bicomponent filaments 2 exhibit core/sheath geometry or bicomponent filaments 1 exhibit core/sheath geometry and bicomponent filaments 2 exhibit another bicomponent geometry, e.g., a side by side geometry or an island in the sea geometry. Consequently, if bicomponent filaments 1 and bicomponent filaments 2 exhibit a core/sheath geometry, component 11 represents the core of bicomponent filaments 1, component 12 represents the sheath of bicomponent filaments 1, component 22 represents the core of bicomponent filaments 2 and component 21 represents the sheath of bicomponent filament 2. However, if bicomponent filaments 1 exhibit core/sheath geometry and bicomponent filaments 2 exhibit another bicomponent geometry, e.g., a side by side geometry, component 11 represents the core of bicomponent filaments 1, component 12 represents the sheath of bicomponent filaments 1, component 22 means side 1 of bicomponent filaments 2 and component 21 means side 2 of bicomponent filaments 2.

According to step a)iβ), at least the bicomponent filaments 1 exhibit a side by side geometry wherein component 11 represents side 1 and component 12 represents side 2. Within the scope of the present disclosure, this means that either bicomponent filaments 1 and bicomponent filaments 2 exhibit side by side geometry or bicomponent filaments 1 exhibit side by side geometry and bicomponent filaments 2 exhibit another bicomponent geometry, e.g., a core/sheath geometry or an island in the sea geometry. Consequently, if bicomponent filaments 1 and bicomponent filaments 2 exhibit a side by side geometry component 11 represents the side 1 of bicomponent filaments 1, component 12 represents side 2 of bicomponent filaments 1, component 22 represents the side 1 of bicomponent filaments 2 and component 21 represents side 2 of bicomponent filaments 2. However, if bicomponent filaments 1 exhibit side by side geometry and bicomponent filaments 2 exhibit another bicomponent geometry, e.g., a core/sheath geometry, component 11 represents side 1 of bicomponent filaments 1, component 12 represents side 2 of bicomponent filaments 1, component 22 means the core of bicomponent filaments 2 and component 21 means the sheath of bicomponent filaments 2.

According to step a)iγ), at least the bicomponent filaments 1 exhibit islands in the sea geometry wherein component 11 represents the islands and component 12 represents the sea. Within the scope of the present disclosure, this means that either bicomponent filaments 1 and bicomponent filaments 2 exhibit an island in the sea geometry or bicomponent filaments 1 exhibit an island in the sea geometry and bicomponent filaments 2 exhibit another bicomponent geometry, e.g. a core/sheath geometry or a side by side geometry. Consequently, if bicomponent filaments 1 and bicomponent filaments 2 exhibit an islands in the sea geometry component 11 represents the islands of bicomponent filaments 1, component 12 represents the sea of bicomponent filaments 1, component 22 represents the islands of bicomponent filaments 2 and component 21 represents the sea of bicomponent filaments 2. However, if bicomponent filaments 1 exhibit islands in the sea geometry and bicomponent filaments 2 exhibit another bicomponent geometry, e.g., a core/sheath geometry component 11 represents the islands of bicomponent filaments 1, component 12 represents the sea of bicomponent filaments 1, component 22 means the core of bicomponent filaments 2 and component 21 means the sheath of bicomponent filaments 2.

The proportion of components 11:12 and of components 22:21 may be in the range of 5:95 to 95:5 vol.-% and preferably between 60:40 and 95:5 vol.-%. The ratio of bicomponent filaments 1 to bicomponent filaments 2 may be in the range of 5:95 to 95:5 wt.-% and is preferably 60:40 wt.-%.

For the sake of conciseness, the advantageous properties of the tufted nonwoven obtained by the process herein shall be explained, in the following, in an embodiment according to a)iα) wherein both bicomponent filaments 1 and 2 exhibit a core/sheath geometry. In this case the relation of temperatures in step iii) reads $T_m$(sheath 1)>$T_m$(sheath 2) and in step iv) reads both $T_m$(core 1) and $T_m$(core 2)>$T_m$(sheath 1)>$T_m$(sheath 2).

The tufted nonwoven obtained by the method of the present disclosure exhibits excellent stitch holding because in step d) at the contacts of the face material with the melt of sheath 2 of the bicomponent filaments the melt starts to flow along and/or around the face material thereby increasing the contact area between the face material and bicomponent filaments 2. By cooling below $T_m$(sheath 2) in step d) the enlarged contact area solidifies and yields a strong adhesion between the face material and the sheath of bicomponent filaments 2. Within the scope of the method according to the present disclosure, heating at $T_m$ till the sheath of bicomponent filaments 2 melts means that at the contacts of the face material with melt of sheath 2 such a quantity of the sheath of bicomponent filaments 2 melts that after cooling below $T_m$(sheath 2), the resulting adhesion between the face material and the sheath of bicomponent filaments 2 is sufficiently strong for the intended uses of the tufted nonwoven described later. If the time, during which $T_m$ is applied to the tufted nonwoven, is sufficient to enable that the melt of sheath 2 can flow completely around the face material, after cooling below $T_m$(sheath 2), a loop of solidified sheath 2 polymer tightly encloses the face material and thereby increases the stitch holding.

Furthermore, a tufted nonwoven results from the method according to the present disclosure without any problems with respect to delamination because the nonwoven obtained by the method is not a laminate.

Finally, the method of the present disclosure yields a tufted nonwoven with kept structural integrity because of the following reasons. In step b) the mixture of the bicomponent filaments 1 and 2 is heated at $T_{np}$>$T_m$(sheath 1) till sheath 1 of bicomponent filaments 1 and sheath 2 of bicomponent filaments 2 melt at the zones of overlap. In these zones of overlap of filaments, skin bonding will occur, thus providing structural integrity of the nonwoven. In step d) the tufted nonwoven is heated only above the melting temperature of sheath 2 of the bicomponent filaments 2. Consequently, in the zones of overlap, sheath 1 remains solid and thereby keeps the integrity of the tufted nonwoven.

One skilled in the art who knows the process of the present disclosure and the above explanation of the advantageous properties of the tufted nonwoven which results from the process is able to adapt this explanation to bicomponent embodiments, e.g., with the islands in the sea geometry or with side by side geometry or with another bicomponent geometry. All such embodiments belong to the scope of the process herein.

Herein, the term "filament" is used in its broadest sense, including mono- or multifilaments which might be spun bond or melt blown or made by another technique known per se. For those skilled in the art, it is clear and will not depart from the scope herein that shorter fibers, such as e.g., staple fibers, can also be used. The usage of the term "filament" is for the sake of convenience only and should not be considered a restriction in terms of the length of the fibers.

The materials which can be used to form the bicomponent filaments 1 and 2 can be selected from a great variety of material classes provided that the melting points of the chosen classes obey to the restrictions which are taught in the process of the present disclosure. For example, filaments of synthetic or natural origin comprising organic polymers can be used belonging, e.g., to the groups of thermoplastics, elastomers or thermoplastic elastomers. The filaments might be biodegradable. Furthermore, filaments comprising inorganic materials, e.g., ceramics, glasses or metals can be used. In the method of the present disclosure, polymers and especially thermoplastic polymers are the preferred materials to be used for the bicomponent filaments 1 and 2.

Within the scope of the present disclosure, the term "face material" means any material suitable for tufting provided that the material virtually does not melt or decompose at $T_m$(sheath 1). That means that the melting temperature of the face material or in the case of a face material which does not exhibit a melting point, the decomposition temperature is higher than $T_m$(sheath 1). The face material can be used in the shape of ribbons, yarns, cord, artificial turf or in any other shape suitable for tufting.

Again, for the sake of conciseness, the preferred embodiments of the process according to the present disclosure shall be explained in an embodiment according to a)iα) wherein both bicomponent filaments 1 and 2 exhibit a core/sheath geometry. In this case as explained before the relation of temperatures in step iii) reads $T_m$(sheath 1)>$T_m$(sheath 2) and in step iv) reads both $T_m$(core 1) and $T_m$(core 2)>$T_m$(sheath 1)>$T_m$(sheath 2).

So, the selection of a polymer which forms the core of bicomponent filaments 1 and 2 is limited by the core's melting point in relation to the melting points of sheath 1 and 2 as defined in step 1a)iv) and, of course, by the properties which are required for the core of a polymeric bicomponent filament to be usable for the manufacture of a tufted nonwoven. Those skilled in the art know the required properties, e.g., strength, elongation, modulus, tuftability, molding behavior, dimensional stability, etc.

So, correspondingly selected polymers can be used as the core for the bicomponent filaments of the present disclosure. For example, the same type of polymer can be used for the core of bicomponent filaments 1 and 2 wherein the melting point of the cores in bicomponent filaments 1 and 2 are equal or not equal, the latter embodiment being realized, e.g., by two polymers of the same type but with different molecular weights. Or two different types of polymers can be used for the cores of bicomponent filaments 1 and 2 having the same or a different melting point. In each of the embodiments, 100 weight % of the core, e.g., of bicomponent filaments 1 can consist of one certain core polymer. But it is also possible that a polymer material is selected for the core of bicomponent filaments 1 and/or 2 comprising an amount of <100 weight % of the core of the corresponding bicomponent filaments, the difference to 100 weight % comprising, e.g., spinning auxiliaries, fillers, flame retardant materials, UV inhibitors, crystallizers, plastisizers, retarders/accelerators, heat stabilizers, antimicrobial additives or combinations thereof.

However, the <100 weight % amount of core polymer must be high enough to ensure that the core properties, which are required for the process of the present disclosure, are realized.

In a preferred embodiment of the process according to the present disclosure, bicomponent filaments 1 exhibit a core/sheath geometry wherein component 11 represents the core and component 12 represents the sheath, wherein bicomponent filaments 2 exhibit a core/sheath geometry wherein component 22 represents the core and component 21 represents the sheath and wherein the cores of bicomponent filaments 1 and of bicomponent filaments 2 comprise a thermoplastic polymer selected from the group consisting of polyethyleneterephthalate (PET), polypropylene (PP), polyamide (PA), polybutyleneterephthalate (PBT), polytrimethyleneterephthalate (PTT), polyphenylenesulfide (PPS), polyethylenenaphthalate (PEN), polyethyleneimide (PEI), polylactic acid (PLA) and polyoxymethylene (POM).

In the method of the present disclosure, the selection of the sheath polymer for bicomponent filaments 1 is limited by the melting point of the sheath of bicomponent filaments 1 in relation to the melting point of the sheath of bicomponent filaments 2 and of the cores as defined in step a)iv) and by the meltability of the sheaths of bicomponent filaments 1 and 2 without substantial degradation, i.e., without a substantial decrease of the properties of the sheath of bicomponent filaments 1 and 2 which are required for polymeric bicomponent filaments to be suited for the manufacture of a tufted nonwoven. Those skilled in the art know the required properties, e.g., strength, elongation, modulus, dye ability, coating behavior, hydrophilic/lipophilic balance, lamination behavior, fusion behavior and bonding strength. And the required properties have to be sufficiently retained in the bonded skins obtained in step b) and after the cooling in step d).

So, correspondingly selected thermoplastic polymers can be used as the sheath for the bicomponent filaments 1 and 2 of the present disclosure. For example, the same type of polymer can be used for the sheaths of bicomponent filaments 1 and 2 wherein the melting points of the sheaths are different, e.g., because of different molecular weights. Or different types of polymers can be used for the sheaths of bicomponent filaments 1 and 2 wherein the melting points of the sheaths are different. In each of the embodiments, the sheath of bicomponent filaments 1 and/or 2 can consist of 100 weight % of a certain thermoplastic polymer. But it is also possible that a selected polymer material for the sheath of bicomponent filaments 1 and/or 2 comprises <100 weight % of a thermoplastic polymer, the difference to 100 weight % comprising, e.g., spinning auxiliaries, fillers, colorants, crystallizers, retarders/accelerators, stabilizers and plastisizers or combinations thereof. However, the <100 weight % amount of sheath polymer amount must be high enough to ensure that the sheath properties which are required for the process of the present disclosure are realized.

Preferably, the sheath of bicomponent filaments 1 comprises a thermoplastic polymer selected from the group consisting of polyamide (PA), e.g., PA 6, polypropylene (PP), polyethylene (PE) or copolymers thereof, polybutyleneterephthalate (PBT), polylactic acid (PLA) and aliphatic polyesters.

Preferably, the sheath of bicomponent filaments 2 comprises a thermoplastic polymer selected from the group consisting of polypropylene (PP), polyethylene (PE) or copolymers thereof, polylactic acid (PLA), polyvinylchloride (PVC).

The selection of a plurality of bicomponent filaments 1 and 2 for the mixing operation in step a) of the method according to the disclosure results in a combination of bicomponent filaments 1 and 2 wherein according to iii) $T_m$(sheath 1) is higher than $T_m$(sheath 2). Preferably $T_m$(sheath 1) is at least 5° C. and most preferably at least 50° C. higher than $T_m$(sheath 2).

Furthermore, the selection of a plurality of bicomponent filaments 1 and 2 for the mixing operation in step a) of the method according to the disclosure results in a combination of bicomponent filaments wherein according to iv) both $T_m$(core 1) and $T_m$(core 2) are higher than $T_m$(sheath 1). Preferably, both $T_m$(core 1) and $T_m$(core 2) are at least 20° C. higher than $T_m$(sheath 1).

In a preferred embodiment of the method of the present disclosure, bicomponent filaments 1 comprise a core of polyethyleneterephthalate with $T_m$(core)=250° C. and a sheath of polyamide 6 with $T_m$(sheath 1)=220° C.

In an especially preferred embodiment of the method of the present disclosure, bicomponent filaments 1 comprise a core of polyethyleneterephthalate with $T_m$(core)=250° C. and a sheath of polyamide 6 with $T_m$(sheath 1)=220° C. and bicomponent filaments 2 comprises a core of polyethyleneterephthalate with $T_m$(core)=250° C. and a sheath of polypropylene with $T_m$(sheath 2)=160° C.

According to step c), a face material is applied for tufting the bonded nonwoven. Preferably, the face material to be used in step c) of the method of the disclosure is selected from the group consisting of polyamide (PA), polypropylene (PP), polylactic acid (PLA), wool and cotton provided that the melting temperature of the polymers and the decomposition temperature of the wool and cotton is higher than $T_m$(sheath 1).

The mixing of a plurality of bicomponent filaments 1 and a plurality of bicomponent filaments 2 in step a) of the method according to the disclosure can be performed by any of the methods known to those skilled in the art, provided that the chosen method of mixing renders a sufficiently homogenous mixture of bicomponent filaments 1 and 2. Within the scope of the present disclosure, the term "homogenous mixture" means that in every given volume element of the basic fibrous layer resulting from step a) of the method, about the same ratio of bicomponent filaments 1 and 2 is realized.

Preferably, the mixing in step a) is performed by assembling or by mixing at a creel or by spinning from 3-component spin packs.

The production of the basic fibrous layer, also called web, may be performed with any of the technologies known for the purpose e.g., with mechanical, pneumatic or wet processing or with electrostatic systems or by using a polymer to web process or with the aid of filament entanglements or with split film methods. Examples for the technologies are e.g. given in chapter 10.1 of the "Manual of nonwovens" (1971), Textile Trade Press, Manchester, England in association with W.R.C. Publishing Co., Atlanta, U.S.A.

The object of the present disclosure, is furthermore achieved by a tufted nonwoven with improved stitch holding comprising a face material, which tufts a bonded nonwoven comprising a mixture of a plurality of bicomponent filaments 1 with a plurality of bicomponent filaments 2 wherein iα) at least bicomponent filaments 1 exhibit a core/sheath geometry wherein component 11 represents the core and component 12 represents the sheath, or iβ) at least bicomponent filaments 1 exhibit a side by side geometry wherein component 11 represents side 1 and component 12 represents side 2, or iγ) at least bicomponent filaments 1 exhibit an islands in the sea geometry wherein component 11 represents the islands and component 12 represents the sea, ii) the component 11 exhibits a melting temperature $T_m(11)$, the component 22 exhibits a melting temperature $T_m(22)$ and $T_m(11)$ is equal to $T_m(22)$ or $T_m(11)$ is not equal to $T_m(22)$, iii) the component 12 exhibits a melting temperature $T_m(12)$, the component 21 exhibits a melting temperature $T_m(21)$ and $T_m(12)$ is higher than $T_m(21)$, and iv) the melting temperatures of both component 11 and 22 and the melting temperatures of components 12 and 21 obey to the relation both $T_m(11)$ and $T_m(22)>T_m(12)>T_m(21)$ and optionally wherein the face material is bonded to bicomponent filaments 2 by a solidified melt of component 21.

The tufted nonwoven, according to the present disclosure, exhibits excellent stitch holding, especially if the face material is bonded to bicomponent filaments 2 by a solidified melt of component 21 of bicomponent filaments 2. Furthermore, the tufted nonwoven does not have any problems with respect to delamination because the nonwoven is not a laminate. Finally, the tufted nonwoven exhibits a high degree of kept structural integrity because of the reasons already explained.

Regarding possible embodiments of the face material, bicomponent filaments and their geometries, meaning of components 11, 12, 21, and 22 in different bicomponent geometries, and general criteria for the selection of materials for the components, the same holds true of what was explained in the description of the process.

For the sake of conciseness, the preferred embodiments of the tufted nonwoven according to the present disclosure shall be explained in an embodiment according to ia) wherein both bicomponent filaments 1 and 2 exhibit a core/sheath geometry. In this case as explained before the relation of temperatures in iii) reads $T_m$(sheath 1)>$T_m$(sheath 2), and in iv) reads both $T_m$(core 1) and $T_m$(core 2)>$T_m$(sheath 1)>$T_m$(sheath 2).

In a preferred embodiment, the tufted nonwoven of the present disclosure comprises a homogenous mixture of a plurality of bicomponent filaments 1 and 2. This means that in every given volume element of the tufted nonwoven about the same ratio of bicomponent filaments 1 and 2 is realized. Consequently, in every volume element of the tufted nonwoven, the face material can be bonded to bicomponent filaments 2 with the aid of a solidified melt of the sheath of bicomponent filaments 2.

In a preferred embodiment of the tufted nonwoven according to the present disclosure, bicomponent filaments 1 exhibit a core/sheath geometry wherein component 11 represents the core and component 12 represents the sheath, wherein bicomponent filaments 2 exhibit a core/sheath geometry wherein component 22 represents the core and component 21 represents the sheath and wherein the cores of bicomponent filaments 1 and of bicomponent filaments 2 comprise a thermoplastic polymer selected from the group consisting of polyethyleneterephthalate (PET), polypropylene (PP), polyamide (PA), polybutyleneterephthalate (PBT), polytrimethyleneterephthalate (PTT), polyphenylenesulfide (PPS), polyethylenenaphthalate (PEN), polyethyleneimide (PEI), polylactic acid (PLA) and polyoxymethylene (POM).

In another preferred embodiment of the tufted nonwoven according to the present disclosure, the sheath of bicomponent filament 1 comprises a thermoplastic polymer selected from the group consisting of polyamide (PA), e.g., PA 6, polypropylene (PP), polyethylene (PE) or copolymers thereof, polybutyleneterephthalate (PBT), polylactic acid (PLA) and aliphatic polyesters.

In still another preferred embodiment of the tufted nonwoven according to the present disclosure, the sheath of bicomponent filament 2 comprises a thermoplastic polymer selected from the group consisting of polypropylene (PP), polyethylene (PE) or copolymers thereof, polylactic acid (PLA) and polyvinylchloride (PVC).

The selection of bicomponent filaments 1 and 2 for the tufted nonwoven according to the disclosure results in a combination of bicomponent filaments wherein according to iii) $T_m$(sheath 1) is higher than $T_m$(sheath 2).Preferably, $T_m$(sheath 1) is at least 5° C., and most preferably at least 50° C. higher than $T_m$(sheath 2).

Furthermore, the selection of bicomponent filaments 1 and 2 for the tufted nonwoven according to the disclosure results in a combination of bicomponent filaments wherein according to iv) both $T_m$(core 1) and $T_m$(core 2) are higher than $T_m$(sheath 1). Preferably, $T_m$(core) is at least 20° C. higher than $T_m$(sheath 1).

In a preferred embodiment of the tufted nonwoven according to the present disclosure, bicomponent filaments 1 comprise a core of polyethyleneterephthalate with $T_m$(core)=250° C. and a sheath of polyamide 6 with $T_m$(sheath 1)=220° C.

In an especially preferred embodiment of the tufted nonwoven according to the present disclosure, bicomponent filaments 1 comprise a core of polyethyleneterephthalate with $T_m$(core)=250° C. and a sheath of polyamide 6 with $T_m$(sheath 1)=220° C. and bicomponent filaments 2 comprise a core of polyethyleneterephthalate with $T_m$(core)=250° C. and a sheath of polypropylene with $T_m$(sheath 2)=160° C.

According to the present disclosure, the tufted nonwoven comprises a face material which tufts a bonded nonwoven. Preferably, the face material is selected from the group consisting of polyamide (PA), polypropylene (PP), polylacetic acid (PLA), wool and cotton provided that the melting temperature of the polymers and the decomposition temperature of the wool and cotton is higher than $T_m$(sheath 1).

The object of the present disclosure is furthermore achieved by a method to manufacture a bonded nonwoven comprising the following:

a) mixing a plurality of bicomponent filaments 1 which comprise a component 11 and a component 12 with a plurality of bicomponent filaments 2 which comprise a component 21 and a component 22 wherein
   - iα) at least bicomponent filaments 1 exhibit a core/sheath geometry wherein component 11 represents the core and component 12 represents the sheath, or
   - iβ) at least bicomponent filaments 1 exhibit a side by side geometry wherein component 11 represents side 1 and component 12 represents side 2, or
   - iγ) at least bicomponent filaments 1 exhibit an islands in the sea geometry wherein component 11 represents the islands and component 12 represents the sea,
   - ii) the component 11 exhibits a melting temperature $T_m(11)$, the component 22 exhibits a melting temperature $T_m(22)$ and $T_m(11)$ is equal to $T_m(22)$ or $T_m(11)$ is not equal to $T_m(22)$,
   - iii) the component 12 exhibits a melting temperature $T_m(12)$, the component 21 exhibits a melting temperature $T_m(21)$ and $T_m(12)$ is higher than $T_m(21)$, and
   - iv) the melting temperatures of both component 11 and 22 and the melting temperatures of components 12 and 21 obey to the relation both $T_m(11)$ and $T_m(22)>T_m(12)>T_m(21)$ and producing a basic fibrous layer in a method known per se in which bicomponent filaments 1 contact bicomponent filaments 2 at zones of overlap, b) heating the basic fibrous layer at a temperature for nonwoven production $T_{np}$ which obeys to the relation $T_m(12)<T_{np}<$both $T_m(11)$ and $T_m(22)$ till component 12 and component 21 melt at the zones of overlap and then cooling below $T_m(21)$ resulting in a bonded nonwoven.

Because of the reasons mentioned before, the method to manufacture a bonded nonwoven according to the disclosure results in a bonded nonwoven of high structural integrity. Within the scope of the present disclosure, heating at $T_{np}$ till component 12 and component 21 melt at the zones of overlap has the same meaning as explained before.

The bonded woven according to the present disclosure, is a suitable intermediate for the manufacture of the tufted nonwoven with kept structural integrity.

Regarding preferred embodiments of the method to manufacture a bonded nonwoven according to the disclosure, reference is made to what was still preferably claimed and described for steps a) and b) of the method to manufacture a tufted nonwoven.

The object of the present disclosure is furthermore achieved by a bonded nonwoven comprising a mixture of a plurality of bicomponent filaments 1 with a plurality of bicomponent filaments 2 wherein

- iα) at least bicomponent filaments 1 exhibit a core/sheath geometry wherein component 11 represents the core and component 12 represents the sheath, or
- iβ) at least bicomponent filaments 1 exhibit a side by side geometry wherein component 11 represents side 1 and component 12 represents side 2, or
- iγ) at least bicomponent filaments 1 exhibit an islands in the sea geometry wherein component 11 represents the islands and component 12 represents the sea,
- ii) the component 11 exhibits a melting temperature $T_m(11)$, the component 22 exhibits a melting temperature $T_m(22)$ and $T_m(11)$ is equal to $T_m(22)$ or $T_m(11)$ is not equal to $T_m(22)$,
- iii) the component 12 exhibits a melting temperature $T_m(12)$, the component 21 exhibits a melting temperature $T_m(21)$ and $T_m(12)$ is higher than $T_m(21)$, and
- iv) the melting temperatures of both component 11 and 22 and the melting temperatures of components 12 and 21 obey to the relation both $T_m(11)$ and $T_m(22)>T_m(12)>T_m(21)$ and wherein bicomponent filaments 1 and bicomponent filaments 2 exhibit zones of overlap at which bicomponent filaments 1 and bicomponent filaments 2 are bonded by component 12 and component 21.

Each of the constituents of the bonded nonwoven according to the present disclosure can be chosen independently from one another within the conditions described before. This enables to introduce specifically desired properties into the bonded nonwoven simply by choosing the appropriate components. Consequently, the bonded nonwoven exhibits a fine tuned property profile, e.g., regarding water uptake, flame retardation etc.

The bonded nonwoven of the present disclosure does not necessarily exhibit a preferred side (symmetrical structure). Consequently, during further process steps with the bonded nonwoven, it is not necessary to take care of which surface is the top side and which surface is the bottom side. If the bonded nonwoven is already to be used as an end product it can be used on both sides.

Because of the reasons mentioned before, the bonded nonwoven according to the disclosure exhibits high structural integrity and is a suitable intermediate for the manufacture of the tufted nonwoven according to the present disclosure with improved stitch holding and kept structural integrity.

Regarding preferred embodiments of the bonded nonwoven according to the disclosure, reference is made to what was still preferably claimed and described for step a)iα)-a)iv) during the description of the method to manufacture a tufted nonwoven according to the present disclosure.

The tufted nonwoven of the present disclosure, and the tufted nonwoven which results from the method according to the present disclosure, exhibit a high degree of structural integrity and stitch holding. Therefore, a backing might not be necessary. Nevertheless, if desired the tufted nonwoven of the present disclosure and/or the tufted nonwoven resulting from the method of the present disclosure can be provided with one or more backings, e.g., with two backings.

Because of the high degree of structural integrity and stitch holding the tufted nonwoven of the present disclosure and the tufted nonwoven resulting from the method of the present disclosure—without or with backing(s)—can be used advantageously to manufacture tufted carpets for home textiles or for cushion vinyl or for decoration or for textiles in automobiles, trains or aircrafts or for out-door applications like synthetic turf or play grounds.

Further on, the tufted nonwoven of the present disclosure and the tufted nonwoven resulting from the method of the present disclosure can be used advantageously for carpet molding for example for car carpets.

It is possible to obtain very fine filament titers by using, e.g., the melt-blown technology for mixing bicomponent filaments 1 and 2 during step a) of the method to manufacture a bonded nonwoven according to the present disclosure by spinning from 3-component spin packs enabling the production of bonded nonwovens with very fine pore sizes, high surface area, and as explained before, with a high degree of structural integrity. Such a bonded nonwoven is highly suitable for bonding in structural, technical and adhesive applications. For example, the bonded nonwoven resulting from the method of the present disclosure and the bonded nonwoven according to the present disclosure can be used advantageously to manufacture filters for technical applications, e.g., filters against dust, carbon-particulate matter, pollen or gases or to manufacture filters for medical applications, e.g., filter against bacteria or viruses or filters which can be used as heat and moisture exchangers. In the latter application, the bonded nonwoven of the present disclosure and the bonded nonwoven resulting from the method of the present disclosure captures heat and moisture from a patients breath during exhalation, and cools and releases the trapped moisture for return to the patient during inspiration. Preferred bicomponent filaments 1 and 2 for the heat and moisture exchanging filter combine a low thermal conductivity with a high hydrophilicity at least on the surface, e.g., realized by core/sheath filaments with a polyamide sheath.

Further on, the bonded nonwoven of the present disclosure and the bonded nonwoven resulting from the method of the present disclosure can advantageously be used as a coalescent filter to separate a hydrophilic fluid from a hydrophobic fluid, e.g. water from aviation fuel. For the use, hydrophilic bicomponent filaments 1 and 2 comprising a hydrophilic surface are needed to allow the hydrophilic fluid to be held and not spread along the filaments.

Further on, the bonded nonwoven of the present disclosure and the bonded nonwoven resulting from the method of the present disclosure can advantageously be used to manufacture a wicking product for use as a reservoir in the transfer of ink in marking and writing instruments for medical wicks or for other products which hold and transfer liquids. For the use, bicomponent filaments 1 and 2 are needed which exhibit a high surface energy which allows the filaments to wick the desired quantity of liquid. Therefore, bicomponent filaments comprising, e.g., polyethylene terephthalate are more suitable for the wicking purposes than bicomponent filaments comprising, e.g., polyolefins.

EXAMPLE

The disclosure is explained in more detail in the following example:

Step a):

For the plurality of bicomponent filaments 1, a yarn is used, consisting of bicomponent filaments which exhibit a core/sheath geometry wherein the core is polyethylene-terephthalate (PET) having a melting temperature $T_m(11)=250°$ C. and the sheath is polyamide 6 ($PA_6$) having a melting $T_m(12)=220°$ C. The volume ratio of sheath/core of this yarn is 26 Vol. %/74 Vol. %.

For the plurality of bicomponent filaments 2 a yarn is used, consisting of bicomponent filaments which exhibit a core/sheath geometry wherein the core is polyethylene-terephthalate (PET) having a melting temperature $T_m(22)=250°$ C. and the sheath is polypropylene (PP) having a melting temperature $T_m(21)=165°$ C. The volume ratio of sheath/core of this yarn is 26 Vol. %/74 Vol. %.

Bicomponent filaments 1 and 2 are mixed in a weight ratio of 1:1, and laid onto a conveyor belt in a well known way. A basic fibrous layer is produced having a weight per unit area of 100 g/m$^2$. As a reference, a basic fibrous layer is produced from a yarn with bicomponent filaments 1 only, also having a weight per unit area of 100 g/m$^2$.

Step b):

The basic fibrous layer according to the disclosure is heated in a through-air bonding drum for about 12 seconds, and at a temperature for nonwoven production $T_{np}=227°$ C. resulting in a bonded nonwoven according to the disclosure. The same heating procedure is performed with the reference basic fibrous layer resulting in a comparative bonded nonwoven. While the comparative bonded nonwoven shows a firm hand, the bonded nonwoven according to the disclosure exhibits a soft and hairy appearance.

Step c):

Before tufting, both the bonded nonwoven according to the disclosure and the comparative bonded nonwoven are treated with a commercially available suitable tuft finish in a known way, which provides the nonwovens with about 1-2 wt. % of the finish. Next, both the bonded nonwoven according to the disclosure and the comparative bonded nonwoven are loop pile tufted with a polyamide 66 pile yarn (white; turns=220S; type 3252 O; heat set; $T_m=250°$ C.) supplied by Texture-Tex on a tufting machine (1/10" staggered; number of stitches per 10 cm=50). The pile height in the rows is 4 mm. The noise of tufting the bonded nonwoven according to the disclosure is much lower than the noise of tufting the comparative bonded nonwoven. From this result, it can be concluded that the mobility of the filaments in the bonded nonwoven according to the disclosure is higher than in the comparative bonded nonwoven.

Step d):

Both the comparative tufted nonwoven and the tufted nonwoven according to the disclosure are heated in an oven during 1.5 minutes at a temperature $T_m=170°$ C. Before and after the heat treatment, the stitch holding both of the comparative tufted nonwoven and of the tufted nonwoven according to the disclosure is measured according to Colbond Test Method 1.1.22 (Mar. 26, 2002) "Stitch holding of carpet samples" are measured as follows.

A representative sample of about 16×16 cm$^2$ is obtained with a die cutting tool from the tufted nonwoven. From the sample, the first center row of pile yarns is removed. Then, the next even or odd twenty pile yarn rows are removed. The ends of ten of the remaining pile yarns in machine direction are manually and carefully pulled out of the back side of the tufted nonwoven. The specimen is fixed in a tentering frame. One end of a pile yarn is fixed in a clamp. The clamp is mounted into the upper clamp of an Instron tensile strength machine provided with a 0-100 N loadcell and has a pulling velocity of 200 mm/min. Then, the pile yarn is drawn perpendicularly out of the back side of the tufted nonwoven for a single tuft or for multiple tufts over a distance of 60 mm or minimal three tufts and the force is measured. The maximum force averaged per pile yarn over the number of tuft(s) is the stitch holding value of the single pile yarn. In the same way, the stitch holding values of the other nine pile yarns are determined. The mean of the total of maximum forces is defined as the stitch holding of the tufted nonwoven.

The Colbond stitch holding test method, wherein the pile yarn is pulled out from the back side of the tufted nonwoven, yields lower stitch holding values than ASTM D 1335 (1998), wherein the pile yarn is drawn from the face side of the tufted nonwoven. In the latter case, the pile yarn is drawn through the primary backing which results in much higher stitch holding values.

The following table shows the results of the stitch holding measurements according to the Colbond test method described above, both before and after the 1.5 minute heat treatment at $T_m=170°$ C.

| Stitch holding of comparative tufted nonwoven (N) | Stitch holding of tufted nonwoven according to the disclosure (N) |
|---|---|
| before heating: 0.49<br>after heating: 0.44 | before heating: 0.87<br>after heating: 0.65 |

The table shows that before heating, the stitch holding of the tufted nonwoven according to the disclosure is 78% higher than the stitch holding of the comparative tufted nonwoven. After heating, the stitch holding of the tufted nonwoven according to the disclosure is 48% higher than the stitch holding of the comparative tufted nonwoven.

The invention claimed is:

1. A method comprising:

a) mixing a plurality of bicomponent filaments 1 which comprise a component 11 and a component 12 with a plurality of bicomponent filaments 2 which comprise a component 21 and a component 22 wherein iα) at least bicomponent filaments 1 exhibit a core/sheath geometry wherein component 11 represents the core and component 12 represents the sheath, or iβ) at least bicomponent filaments 1 exhibit a side by side geometry wherein component 11 represents side 1 and component 12 represents side 2, or iγ) at least bicomponent filaments 1 exhibit an islands in the sea geometry wherein component 11 represents the islands and component 12 represents the sea, ii) the component 11 exhibits a melting temperature $T_m(11)$ and the component 22 exhibits a melting temperature $T_m(22)$, iii) the component 12 exhibits a melting temperature $T_m(12)$, the component 21 exhibits a melting temperature $T_m(21)$, and $T_m(12)$ is higher than $T_m(21)$, and iv) the melting temperatures of component 11 and component 22, and the melting temperatures of components 12 and 21, obey a relationship in which $T_m(11)$ and $T_m(22)>T_m(12)>T_m(21)$, and producing a basic fibrous layer in which bicomponent filaments 1 contact bicomponent filaments 2 at zones of overlap, and b) heating the basic fibrous layer at a temperature for nonwoven production $T_{np}$, which obeys a relationship in which $T_m(12)<T_{np}<$both $T_m(11)$ and $T_m(22)$, until component 12 and component 21 melt at the zones of overlap and then cooling below $T_m(21)$ resulting in a bonded nonwoven.

2. The method according to claim 1, further comprising:

c) tufting the bonded nonwoven with a face material resulting in a tufted nonwoven, exhibiting contacts between the face material and bicomponent filaments 1 and 2, and optionally d) heating the tufted nonwoven at a temperature $T_{tn}$, which obeys a relationship in which $T_m(12)>T_{tn}>T_m(21)$, until component 21 melts resulting in a tufted nonwoven in which molten component 21 contacts the face material and then cooling the nonwoven below $T_m(21)$ to obtain a tufted nonwoven.

3. The method according to claim 1, wherein bicomponent filaments 1 exhibit a core/sheath geometry wherein component 11 represents the core and component 12 represents the sheath, wherein bicomponent filaments 2 exhibit a core/sheath geometry, wherein component 22 represents the core and component 21 represents the sheath, and wherein the cores of bicomponent filaments 1 and bicomponent filaments 2 comprise a thermoplastic polymer selected from the group consisting of polyethyleneterephthlate (PET), polypropylene (PP), polyamide (PA), polybutyleneterephthalate (PBT), polytrimethyleneterephthalate (PTT), polyphenylenesulfide (PPS), polyethylenenaphthalate (PEN), polyethyleneimide (PEI), polylactic acid (PLA) and polyoxymethylene (POM).

4. The method according to claim 3, wherein the sheath of bicomponent filament 1 comprises a thermoplastic polymer selected from the group consisting of polyamide (PA), polypropylene (PP), polyethylene (PE) or copolymers thereof, polybutyleneterephthalate (PBT), polylactic acid (PLA) and aliphatic polyesters.

5. The method according to claim 3, wherein the sheath of bicomponent filaments 2 comprises a thermoplastic polymer selected from the group consisting of polypropylene (PP), polyethylene (PE) or copolymers thereof, polylactic acid (PLA) and polyvinylchloride (PVC).

6. The method according to claim 3, wherein in a) iii), $T_m(12)$ represents the melting temperature $T_m$(sheath 1) of the sheath of bicomponent filaments 1, $T_m(21)$ represents the melting temperature $T_m$(sheath 2) of the sheath of bicomponent filaments 2, and $T_m$(sheath 1) is at least 5° C. higher than $T_m$(sheath 2).

7. The method according to claim 3, wherein in a) iv), $T_m(11)$ represents the melting temperature $T_m$(core 1) of the core of bicomponent filaments 1, $T_m(22)$ represents the melting temperature $T_m$(core 2) of the core of bicomponent filaments 2, and both $T_m$(core 1) and $T_m$(core 2) are at least 20° C. higher than $T_m$(sheath 1).

8. The method according to claim 3, wherein bicomponent filaments 1 comprise a core of polyethyleneterephthalate and $T_m$(core 1)=250° C. and a sheath of polyamide 6 and $T_m$(sheath 1)=220° C.

9. The method according to claim 8, wherein bicomponent filaments 2 comprise a core of polyethyleneterephthalate and $T_m$(core 2)=250 ° C. and a sheath of polypropylene and $T_m$(sheath 2)=160° C.

10. The method according to claim 2, wherein in c), a face material is used which is selected from the group consisting of polyamide (PA), polypropylene (PP), polylactic acid (PLA), wool and cotton.

11. The method according to claim 1, wherein the mixing in a) is performed by assembling or by mixing at a creel or by spinning from 3-component spin packs.

12. Tufted nonwoven comprising a face material which tufts a bonded nonwoven comprising a mixture of a plurality of bicomponent filaments 1 with a plurality of bicomponent filaments 2 wherein iα) at least bicomponent filaments 1 exhibit a core/sheath geometry wherein component 11 represents the core, and component 12 represents the sheath, or iβ) at least bicomponent filaments 1 exhibit a side by side geometry wherein component 11 represents side 1, and component 12 represents side 2, or iγ) at least bicomponent filaments 1 exhibit an islands in the sea geometry wherein component 11 represents the islands, and component 12 represents the sea, ii) the component 11 exhibits a melting temperature $T_m(11)$, and the component 22 exhibits a melting temperature $T_m(22)$, iii) the component 12 exhibits a melting temperature $T_m(12)$, the component 21 exhibits a melting temperature $T_m(21)$, and $T_m(12)$ is higher than $T_m(21)$, and iv) the melting temperatures of component 11 and component 22, and the melting temperatures of components 12 and 21, obey a relationship in which $T_m(11)$ and $T_m(22)>T_m(12)>T_m(21)$, wherein the bonded nonwoven is derived by heating until component 12 and component 21 melt at the zones of overlap and then cooling, and optionally wherein the face material is bonded to bicomponent filaments 2 by a solidified melt of component 21.

13. Tufted nonwoven according to claim 12, wherein bicomponent filaments 1 exhibit a core/sheath geometry, wherein component 11 represents the core and component 12 represents the sheath, wherein bicomponent filaments 2 exhibit a core/sheath geometry, wherein component 22 represents the core and component 21 represents the sheath, and wherein the cores of bicomponent filaments 1 and of bicomponent filaments 2 comprise a thermoplastic polymer selected from the group consisting of polyethyleneterephthalate (PET), polypropylene (PP), polyamide (PA), polybutyleneterephthalate (PBT), polytrimethyleneterephthalate (PTT), polyphenylenesulfide (PPS), polyethylenenaphthalate (PEN), polyethyleneimide (PEI), polylactic acid (PLA) and polyoxymethylene (POM).

14. Tufted nonwoven according to claim 13, wherein the sheath of bicomponent filaments 1 comprises a thermoplastic polymer selected from the group consisting of polyamide (PA), polypropylene (PP), polyethylene (PE) or copolymers thereof, polybutyleneterephthalate (PBT), polylactic acid (PLA) and aliphatic polyesters.

15. Tufted nonwoven according to claim 13, wherein the sheath of bicomponent filaments 2 comprises a thermoplastic polymer selected from the group consisting of polypropylene (PP), polyethylene (PE) or copolymers thereof, polylactic acid (PLA) and polyvinylchloride (PVC).

16. Tufted nonwoven according to claim 13, wherein in iii), $T_m$(12) represents the melting temperature $T_m$(sheath 1) of the sheath of bicomponent filaments 1, $T_m$(21) represents the melting temperature $T_m$(sheath 2) of the sheath of bicomponent filaments 2, and $T_m$(sheath 1) is at least 5° C. higher than $T_m$(sheath 2).

17. Tufted nonwoven according to claim 13, wherein in iv), $T_m$(11) represents the melting temperature $T_m$(core 1) of the core of bicomponent filaments 1, $T_m$(22) represents the melting temperature $T_m$(core 2) of the core of bicomponent filaments 2, and both $T_m$(core 1) and $T_m$(core 2) are at least 20° C. higher than $T_m$(sheath 1).

18. Tufted nonwoven according to claim 13, wherein bicomponent filaments 1 comprise a core of polyethyleneterephthalate and $T_m$(core 1) =250° C. and a sheath of polyamide 6 and $T_m$(sheath 1)=220° C.

19. Tufted nonwoven according to claim 18, wherein bicomponent filaments 2 comprise a core of polyethyleneterephthalate and $T_m$(core 2)=250° C. and a sheath of polypropylene and $T_m$(sheath 2)=160° C.

20. Tufted nonwoven according to claim 12, wherein the face material is selected from the group consisting of polyamide (PA), polypropylene (PP), polylactic acid (PLA), wool and cotton.

21. The method according to claim 2, wherein the method further comprises incorporating the tufted nonwoven into tufted carpets for home textiles, for cushion vinyl, for decoration, for textiles in automobiles, trains or aircrafts or for synthetic turf or play grounds.

22. The method according to claim 2, wherein the method further comprises incorporating the tufted nonwoven into carpet molding.

23. The method according to claim 1, wherein the method further comprises incorporating the bonded nonwoven into filters for technical or medical applications.

24. The method according to claim 1, wherein the method further comprises incorporating the bonded nonwoven into a coalescent filter to separate a hydrophilic fluid from a hydrophobic fluid.

25. The method according to claim 1, wherein the method further comprises incorporating the bonded nonwoven into a wicking product for use as a reservoir in the transfer of ink in marking and writing instruments, for medical wicks or for other products which hold and transfer liquids.

* * * * *